US005743440A

United States Patent [19]

De Laforcade

[11] Patent Number: 5,743,440

[45] Date of Patent: Apr. 28, 1998

[54] DISPENSING ASSEMBLY INCLUDING A BUILT-DISPENSING HEAD RETRACTED INSIDE THE BODY OF THE CONTAINER AND METHOD FOR MANUFACTURING THE DISPENSING ASSEMBLY

[75] Inventor: Vincent De Laforcade, Rambouillet, France

[73] Assignee: L'Oreal, Paris, France

[21] Appl. No.: 650,714

[22] Filed: May 20, 1996

[30] Foreign Application Priority Data

May 18, 1995 [FR] France ..... 95 05921

[51] Int. Cl.[6] ..... B65D 37/00

[52] U.S. Cl. ..... 222/209

[58] Field of Search ..... 222/209, 321.2, 222/321.7, 401, 529, 383.1

[56] References Cited

U.S. PATENT DOCUMENTS 2,774,518 12/1956 Greene ..... 222/209
3,618,829 11/1971 Elmore ..... 222/209
4,602,728 7/1986 Ha .
5,244,125 9/1993 Robbins, III ..... 222/529

FOREIGN PATENT DOCUMENTS

WO 92/01551 2/1992 WIPO .
WO 93/15995 8/1993 WIPO .

*Primary Examiner*—Philippe Derakshani
*Attorney, Agent, or Firm*—Oblon, Spivak, McClelland, Maier & Neustadt, P.C.

[57] ABSTRACT

The invention relates to an assembly for dispensing product, as well as to a method for manufacturing it. This assembly includes a container having a body (3) with a flat end wall; a cone-frustum-shaped throat (5) having a large cross section and a small cross section, the large cross section being attached to the opposite end from the end wall of the container and the small cross section to a neck (6); a dispensing member (7) mounted on the neck of the container including an actuating rod (10) and communicating with a dispensing orifice (92); and an actuating device (9) fixed on the rod (10), this actuating device being capable of actuating the dispensing member to cause the dispensing of a dose of product. The cone frustum extends inwardly of the container and the neck extends outwardly of the container, so that the neck and the dispensing member are housed inside the cone frustum.

22 Claims, 1 Drawing Sheet

DISPENSING ASSEMBLY INCLUDING A BUILT-DISPENSING HEAD RETRACTED INSIDE THE BODY OF THE CONTAINER AND METHOD FOR MANUFACTURING THE DISPENSING ASSEMBLY

BACKGROUND OF THE INVENTION

1. Field of the Invention

The present invention relates to a dispensing assembly including a container intended to contain a liquid, gelled or pasty product, and to a method for manufacturing this assembly.

This container is more specifically intended to contain a cosmetic, pharmaceutical, household or food product such as a shampoo, a body milk, an antiseptic, a detergent or alternatively, for example, mustard.

This container is especially in the form of a bottle including a built-in dispensing head. The dispensing head according to the invention is generally equipped with a dispensing member such as a pump retracted inside the body of the container containing the product.

2. Discussion of Background

A container including a body equipped with a spray head which can be retracted into the body of the container is known, for example from the document WO-A-93/00361. The spray head is mounted on a region of the body which is in the shape of a cone frustum including a larger and a smaller cross section which can enter the body of the container when stored empty, especially when there is no product left, so that the cone frustum extends from its larger cross section to its smaller cross section inwardly of the container. For use, the cone frustum carrying the pouring spout is pulled out of the body; the cone frustum is thus, as it were, untucked. While the product is being dispensed, the cone frustum is therefore untucked towards the outside of the container, and the dispensing head is retracted with a view to reducing the volume of the container when empty.

SUMMARY OF THE INVENTION

The object of the present invention is to provide a dispensing container which, by contrast to the container of the prior art, is equipped with a dispensing member integral with a cone-frustum-shaped throat which is retracted not only during transportation but also during use.

According to the invention this cone frustum extends outwardly of the container for the filling of the container and for the mounting of the dispensing member on the container. The cone frustum is tucked up inside the body of the container before the device is first used. In this tucked-up configuration, the dispensing container of the invention has a particularly compact form, which is advantageous and allows the volume and packaging and storage costs to be reduced.

In addition to the aforementioned advantages, the device of the invention has a nice attractive appearance.

More precisely, the invention relates to an assembly for dispensing product, comprising a container in the form of a bottle having a body with a closed end wall; a cone-frustum-shaped throat having a larger cross section and a smaller cross section, the larger cross section being attached to an opposite end from the end wall of the container and the smaller cross section being attached to a neck; a dispensing member mounted on the neck of the container communicating with a dispensing orifice; means for actuating the dispensing member to cause dispensing of a dose of product contained in the container, the neck extending outwardly of the container and the cone frustum extending inwardly of the body of the container so that, while the assembly is in use, the neck and at least part of the dispensing member are housed inside the cone frustum.

Advantageously, the dispensing member is a dispensing pump with an emerging actuating rod having a given operating stroke. The pump is fixed to the neck by a fixing element, for example with the aid of a screw-on or snap-on ring having a given height. Advantageously, the throat has a height substantially equal to that of the stroke of the pump increased by the height of the fixing element. The pump may be equipped with a dip tube stretching as far as the end wall of the container.

Preferably the pump rod is connected to a dispensing head which constitutes the means for actuating the pump.

According to a specific embodiment of the invention the container body has the shape of a segment of a spherical cup, and the dispensing head in this case has the shape of a spherical segment which complements the segment of the body so that the dispensing head and the body of the container lie within the outline of a sphere, thus forming a compact assembly. Advantageously, the dispensing head and the body of the container are separated by a distance equal to or greater than that of the stroke of the pump rod. It is quite clear that the body may have any conceivable shape, for example the shape of a cylinder, of a cube, etc.

Advantageously the dispensing head may include a cylindrical cover the height of which corresponds substantially to the distance of the stroke of the pump, when actuated, this cover extending towards the dispensing pump. In this way, the neck and throat of the container, the pump, and the fixing ring remain invisible from the outside.

To make it easier to dispense product and to avoid the body becoming soiled, the dispensing head may include a dispensing spout equipped with the dispensing orifice, this spout extending radially with respect to an axis of the body, especially an axis of symmetry. Advantageously, a dispensing duct connecting the dispensing orifice to the pump rod passes through the dispensing head.

Preferably in the direction from its larger cross section to its smaller cross section the cone frustum extends towards the inside of the body of the container.

The present invention also relates to a process for manufacturing and packaging the assembly described hereinabove, consisting in carrying out, in succession, the following steps:

- blow-moulding a container having a body with a closed end wall including a cone-frustum-shaped throat having a larger cross section and a smaller cross section, the larger cross section being attached to the opposite end from the end wall of the container and the smaller cross section being attached to a neck, this cone extending outwardly of the body of the container and being extended by the neck on the same side as its smaller cross section;
- filling the container with an appropriate amount of product;
- fixing the dispensing member on the neck of the container;
- mounting means for actuating the dispensing member; and
- driving the throat towards the inside of the container by pressing on the actuating means, so as to place the neck and at least part of the dispensing member inside the cone frustum.

By this last operation, the throat is therefore tucked in from an external position into an internal position, relative to the body of the container.

The body of the container is advantageously obtained by blow-moulding a thermoplastic such as polypropylene or polyethylene, the actuating means being moulded, for example, in polypropylene.

BRIEF DESCRIPTION OF THE DRAWINGS

To make the present invention easier to understand, there will now be described, by way of purely illustrative and non-limiting example, one embodiment of the dispensing assembly in accordance with the invention, represented in the attached drawings, in which.

DETAILED DESCRIPTION OF THE PREFERRED EMBODIMENTS

Figure 1:
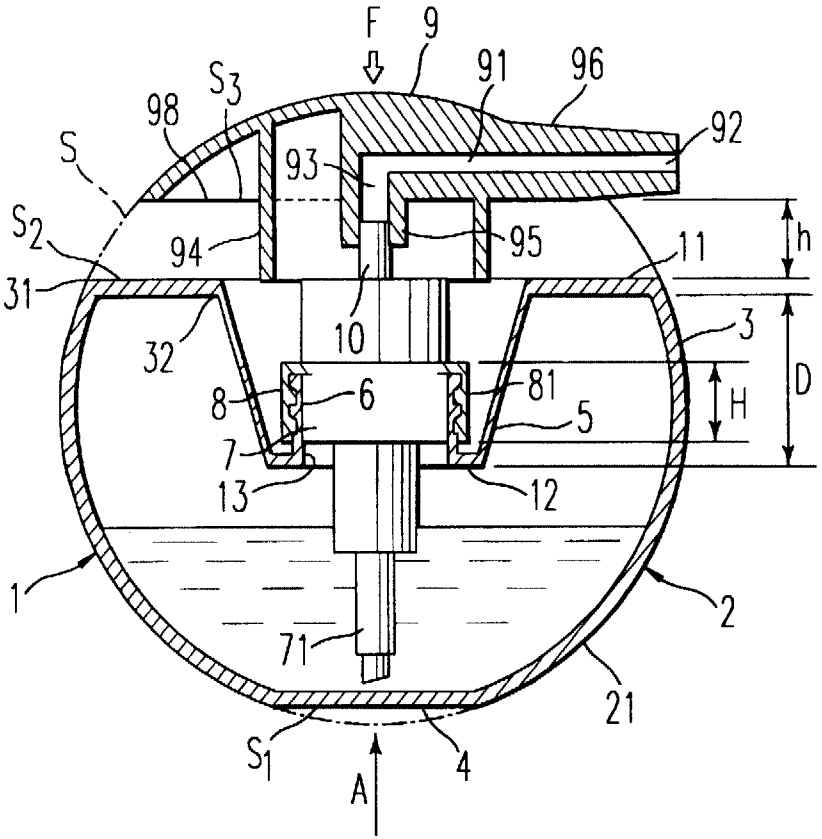
FIG. 1 represents an axial section through the dispensing container according to the invention, in the position of use.

With reference to FIG. 1, it is possible to see a dispensing assembly including a container body 2 surmounted by a dispensing head 9 constituting actuating means. The container 2 has an axis of symmetry A. The body of the container 2 comprises a closed end wall 4, a peripheral side wall 21 connected to the end wall and an annular plate 11 which forms an upper end of the container and is connected to the side wall. The container 2 and the head 9 lie within the outline of a sphere S as follows. The body of the container has the shape of a segment of a sphere through which a first cut $S_1$ defines the end wall 4. A second cut $S_2$ parallel to the first one defines the upper annular plate 11. The peripheral side wall 21 which forms part of the surface of the sphere S connects the end wall 4 to the plate 11, via a circular external rim 31.

The dispensing head 9 has the shape of a cup or segment of a sphere, which complements the shape of the body of the container 2 and caps it; in this way, the external surface of the head also forms part of the surface of the sphere S. It has a circular base 98 situated at the distance h from the plate 11.

A third cut $S_3$ through the sphere S parallel to the first two cuts $S_1$ and $S_2$ defines the circular base 98 of the dispensing head 9. The dispensing head also includes a spout 96 extending radially beyond the base 98. This spout has an orientation perpendicular to the axis A. An elbowed dispensing duct 91 ending at the outside in a dispensing orifice 92 passes through it. The duct 91 has an internal leg 93 oriented along the axis A. This leg 93 ends in a hollow central fitting 95 in which the rod 10 of the pump 7 is forcibly engaged.

The plate 11 of the container 2 has a circular internal rim 32 of smaller diameter than the external rim 31. Connected to this internal rim is the frustoconical wall of a throat 5 extending inwardly of the container and forming an axisymmetric dish in the shape of a cone frustum. This cone frustum, of height D, is closed by a circular end wall 12 the diameter of which is smaller than that of the circular internal rim 31 of the plate 11. The end wall 12 is provided with an opening 13 extended towards the outside by a cylindrical neck 6 of the same diameter as the opening 13. This neck 6 extends substantially as far as halfway up the height D of the dish. Inserted in this neck is a pump 7 fixed to the neck 6 with the aid of a fixing ring 8 of height H. The pump 7 has an actuating and dispensing rod 10, the actuating travel of which is represented by the reference h.

The actuating rod 10 is acted upon by pressing on the dispensing head 9 and driving it through the distance h in the direction of the axis A, causing a dose of product to be dispensed.

Advantageously, the height of the cone frustum D is substantially equal to the travel h of the pump increased by the height H of the fixing ring 8 of the pump. Here, fixing has been achieved by screwing the ring 8 onto the neck 6, the ring having an internal screw thread 81 interacting with an external screw thread 61 on the neck. It is just as possible to fix the ring on the neck by snap-fastening, or by any other suitable means.

On the inside, the dispensing head 9 also has a cylindrical skirt 94 forming a cover for the pump 7 and the actuating rod 10. The inside diameter of this cover is larger than that of the pump 7, and smaller than that of the rim 32. Its height is at least equal to the stroke h of the pump.

Figure 2:
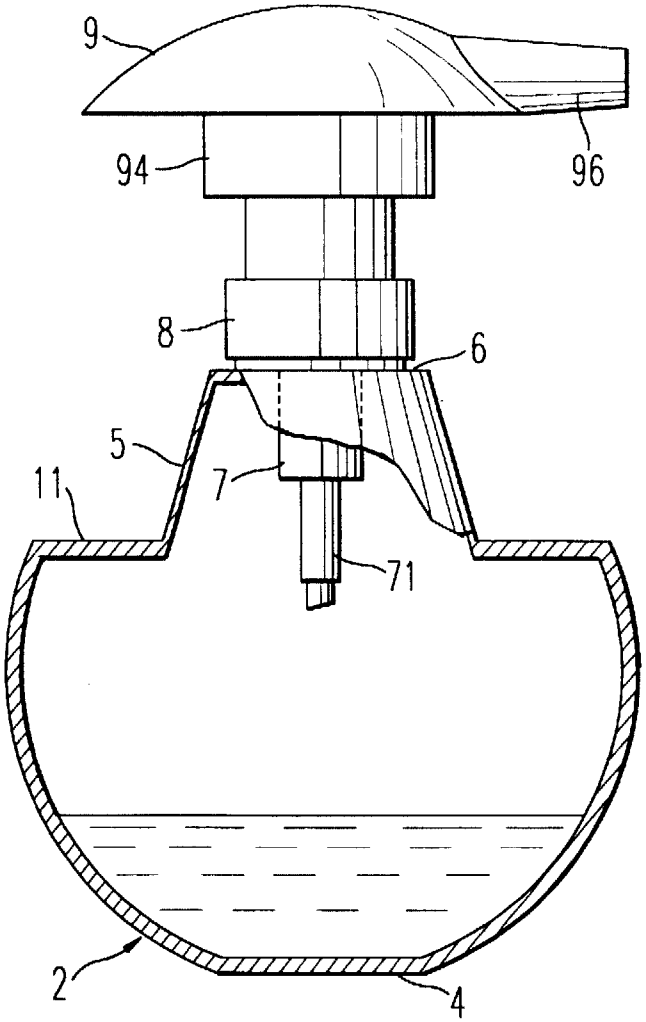
FIG. 2 represents an axial section through the container of FIG. 1, while it is being packaged.

The packaging of this dispensing assembly will be illustrated in greater detail hereinbelow with reference to FIG. 2.

As shown in this Figure, use is made of a container 2 including a frustoconical throat 5 and a cylindrical neck 6 extending outwardly of the container 2, the larger cross section of the throat being secured to the container 2, and the smaller cross section of the throat being secured to the neck 6. This container 2 is filled with a suitable amount of the product to be dispensed, taking care to leave a free volume of air corresponding to the volume of the throat 5.

Next, the pump 7 is fixed onto the neck 6 of the container using the ring 8. The actuating means 9 are then fitted so as to engage the rod 10 of the pump 7 in the hollow fitting 95 thereof. Thereafter, a pressure is exerted on the actuating means so as to drive the frustoconical throat 5 inside the container 2. During this operation, the throat 5 is tucked in and the pump 7 with its fixing ring 8 comes inside the throat 5. This is then the configuration shown in FIG. 1 and the dispensing assembly is ready for use.

To dispense a dose of product, the user presses axially several times on the dispensing head 9 in order to prime the pump, as indicated by the arrow F. Moreover, the priming of the pump is made easier by the fact that an overpressure prevails inside the container 2 after the throat 5 has been driven in, because this operation reduces the effective volume of the container. After the pump has been primed, each actuation on the dispensing head 9 will cause a dose of product to be ejected.

It is possible to provide means (not represented) for locking the dispensing head 9 in order to immobilize it, for example during transportation or storage of the assembly.

I claim:

1. An assembly for dispensing product, comprising a container having a body with a closed end wall; a cone-frustum-shaped throat having a larger cross section and a smaller cross section, the larger cross section being attached to an opposite end from the end wall of the container and the smaller cross section being attached to a neck; a dispensing member mounted on the neck of the container communicating with a dispensing orifice; and means for actuating the dispensing member to cause dispensing of a dose of product contained in the container, characterized in that while the assembly is being used the neck extends outwardly of the container and the core frustum extends inwardly of the body of the container so that the neck and at least part of the dispensing member are housed inside the cone frustum.

2. An assembly according to claim 1, characterized in that the dispensing member is a pump having an operating stroke, the pump being fixed to the neck by a fixing element having a height, and the throat having a height substantially equal to that of the stroke of the pump increased by the height of the fixing element.

3. An assembly according to claim 1, characterized in that the container body has the shape of a segment of a spherical cup which, together with the actuating means, lies within the outline of a sphere.

4. An assembly according to claim 2, characterized in that the actuating means include a cylindrical cover, the height of which corresponds substantially to the stroke of the pump, this cover extending towards the dispensing member.

5. An assembly according to claim 1, characterized in that the actuating means include a dispensing spout equipped with the dispensing orifice extending radially with respect to an axis of symmetry of the body.

6. An assembly according to claim 1, characterized in that the cone frustum extends in a direction inwardly of the body of the container from its larger cross section to its smaller cross section.

7. A process for packaging an assembly in accordance with claim 1, consisting in carrying out, in succession, the following steps:

providing a blow-moulded container having a body with a closed end wall including a cone-frustum-shaped throat having a larger cross section and a smaller cross section, the larger cross section being attached to the opposite end from the end wall of the container and the smaller cross section being attached to a neck, this cone extending outwardly of the body of the container and being extended by the neck on the same side as its smaller cross section;

filling the container with an appropriate amount of product;

fixing the dispensing member on the neck of the container;

mounting means for actuating the dispensing member; and driving the throat towards the inside of the container by pressing on the actuating means, so as to place the neck and at least part of the dispensing member inside the cone frustum.

8. A process according to claim 7, characterized in that the container is equipped with a throat which can be driven into a tucked-in position.

9. An assembly according to claim 2, characterized in that the container body has the shape of a segment of a spherical cup which, together with the actuating means, lies within the outline of a sphere.

10. An assembly according to claim 3, characterized in that the actuating means include a cylindrical cover, the height of which corresponds substantially to a stroke of a pump, this cover extending towards the dispensing member.

11. An assembly according to claim 2, characterized in that the actuating means include a dispensing spout equipped with the dispensing orifice extending radially with respect to an axis of symmetry of the body.

12. An assembly according to claim 3, characterized in that the actuating means include a dispensing spout equipped with the dispensing orifice extending radially with respect to an axis of symmetry of the body.

13. An assembly according to claim 4, characterized in that the actuating means include a dispensing spout equipped with the dispensing orifice extending radially with respect to an axis of symmetry of the body.

14. An assembly according to claim 2, characterized in that the cone frustum extends in a direction inwardly of the body of the container from its larger cross section to its smaller cross section.

15. An assembly according to claim 3, characterized in that the cone frustum extends in a direction inwardly of the body of the container from its larger cross section to its smaller cross section.

16. An assembly according to claim 4, characterized in that the cone frustum extends in a direction inwardly of the body of the container from its larger cross section to its smaller cross section.

17. An assembly according to claim 5, characterized in that the cone frustum extends in a direction inwardly of the body of the container from its larger cross section to its smaller cross section.

18. A process for packaging an assembly in accordance with claim 2, consisting in carrying out, in succession, the following steps:

providing a blow-moulded container having a body with a closed end wall including a cone-frustum-shaped throat having a larger cross section and a smaller cross section, the larger cross section being attached to the opposite end from the end wall of the container and the smaller cross section being attached to a neck, this cone extending outwardly of the body of the container and being extended by the neck on the same side as its smaller cross section;

filling the container with an appropriate amount of product;

fixing the dispensing member on the neck of the container;

mounting means for actuating the dispensing member; and driving the throat towards the inside of the container by pressing on the actuating means, so as to place the neck and at least part of the dispensing member inside the cone frustum.

19. A process for manufacturing and packaging an assembly in accordance with claim 3, consisting in carrying out, in succession, the following steps:

blow-moulding a container having a body with a closed end wall including a cone-frustum-shaped throat having a larger cross section and a smaller cross section, the larger cross section being attached to the opposite end from the end wall of the container and the smaller cross section being attached to a neck, this cone extending outwardly of the body of the container and being extended by th eneck on the same side as its smaller cross section;

filling the container with an appropriate amount of product;

fixing the dispensing member on the neck of the container;

mounting means for actuating the dispensing member; and driving the throat towards the inside of the container by pressing on the actuating means, so as to place the neck and at least part of the dispensing member inside the cone frustum.

20. A process for manufacturing and packaging an assembly in accordance with claim 4, consisting in carrying out, in succession, the following steps:

blow-moulding a container having a body with a closed end wall including a cone-frustum-shaped throat having a larger cross section and a smaller cross section, the larger cross section being attached to the opposite end from the end wall of the container and the smaller cross section being attached to a neck, this cone extending outwardly of the body of the container and being extended by th eneck on the same side as its smaller cross section;

filling the container with an appropriate amount of product;

fixing the dispensing member on the neck of the container;

mounting means for actuating the dispensing member; and driving the throat towards the inside of the container by pressing on the actuating means, so as to place the neck and at least part of the dispensing member inside the cone frustum.

21. A process for manufacturing and packaging an assembly in accordance with claim 5, consisting in carrying out, in succession, the following steps:

blow-moulding a container having a body with a closed end wall including a cone-frustum-shaped throat having a larger cross section and a smaller cross section, the larger cross section being attached to the opposite end from the end wall of the container and the smaller cross section being attached to a neck, this cone extending outwardly of the body of the container and being extended by th eneck on the same side as its smaller cross section;

filling the container with an appropriate amount of product;

fixing the dispensing member on the neck of the container;

mounting means for actuating the dispensing member; and driving the throat towards the inside of the container by pressing on the actuating means, so as to place the neck and at least part of the dispensing member inside the cone frustum.

22. A process for manufacturing and packaging an assembly in accordance with claim 6, consisting in carrying out, in succession, the following steps:

blow-moulding a container having a body with a closed end wall including a cone-frustum-shaped throat having a larger cross section and a smaller cross section, the larger cross section being attached to the opposite end from the end wall of the container and the smaller cross section being attached to a neck, this cone extending outwardly of the body of the container and being extended by th eneck on the same side as its smaller cross section;

filling the container with an appropriate amount of product;

fixing the dispensing member on the neck of the container;

mounting means for actuating the dispensing member; and driving the throat towards the inside of the container by pressing on the actuating means, so as to place the neck and at least part of the dispensing member inside the cone frustum.

* * * * *

UNITED STATES PATENT AND TRADEMARK OFFICE

CERTIFICATE OF CORRECTION

PATENT NO. : 5,743,440

DATED : April 28, 1998

INVENTOR(S) : Vincent De LAFORCADE

It is certified that error appears in the above-identified patent and that said Letters Patent is hereby corrected as shown below:

On the title page, Item [54] title is incorrect. It should read:

--DISPENSING ASSEMBLY INCLUDING A BUILT-IN DISPENSING HEAD RETRACTED INSIDE THE BODY OF THE CONTAINER AND METHOD FOR MANUFACTURING THE DISPENSING ASSEMBLY--

Signed and Sealed this

Fifteenth Day of September, 1998

*Attest:*

Bruce Lehman

BRUCE LEHMAN

*Attesting Officer*

*Commissioner of Patents and Trademarks*